United States Patent [19]

Kobayashi et al.

[11] 4,073,585

[45] Feb. 14, 1978

[54] SHEET REMOVING DEVICE FOR USE IN ELECTROPHOTOGRAPHIC COPYING MACHINE

[75] Inventors: Tatsuo Kobayashi, Machida; Akira Miyazaki, Isehara, both of Japan

[73] Assignee: Rank Xerox Ltd., London, England

[21] Appl. No.: 709,156

[22] Filed: July 27, 1976

[30] Foreign Application Priority Data

Sept. 26, 1975 Japan ..... 50-115656

[51] Int. Cl.[2] ..... G03G 15/04; B65H 7/06

[52] U.S. Cl. ..... 355/14; 271/4; 271/64; 271/258; 271/DIG. 2; 271/DIG. 9

[58] Field of Search ..... 271/258, 263, 262, DIG. 2, 271/DIG. 9, 4, 174, 80, 64, 272, 275, 265, 3, 259; 355/14, 3 R

[56] References Cited

U.S. PATENT DOCUMENTS

| | | | |
|---|---|---|---|
| 3,521,060 | 7/1970 | Seldin | 355/14 X |
| 3,840,224 | 10/1974 | Zawiski | 271/263 |

*Primary Examiner*—Bruce H. Stoner, Jr.

[57] ABSTRACT

A sheet removing device for use in an electrophotographic copying machine which removes unstripped sheets from the photosensitive body by providing feed rollers which rotate in reverse upon a stripping failure to pull the sheet off the photosensitive body by acting on the trailing edge portion of the sheet.

3 Claims, 3 Drawing Figures

SHEET REMOVING DEVICE FOR USE IN ELECTROPHOTOGRAPHIC COPYING MACHINE

BACKGROUND OF THE INVENTION

This invention relates to a sheet removing device for an electrophotographic copying machine, and more particularly to a sheet removing device which serves, after image-transfer, to strip the sheet off a photosensitive body.

Hitherto, electrophotographic copying machines using sheets which are cut into a predetermined size have been provided with devices for stripping the sheet, after image-transfer, off a photosensitive body so as to feed the sheet smoothly to a fixing station. However, there sometimes occurs a failure in stripping the sheet off the photosensitive body. To overcome such a disadvantage, the aforesaid device has been provided with a detector for alerting the machine operator that a misstrip has occurred to allow the operator to stop the copying machine and remove the sheet off the photosensitive body. This operation is both time consuming and troublesome and, in the case of small-sized sheets, it may be necessary to remove the photosensitive body from the copying machine to strip off the sheet, resulting in the lowering in working efficiency as well as giving rise to the probability of damaging the photosensitive body.

This invention is directed to avoiding the aforesaid disadvantages by providing a sheet removing device for use in an electrophotographic copying machine which removes an unstripped sheet from a photosensitive body in a short time by providing feed rollers which start to rotate in reverse upon a stripping failure.

The above and other objects, features and advantages of the present invention will become clear from the following description, taken in conjunction with the accompanying drawings which show by way of example a preferred embodiment of the invention.

BRIEF DESCRIPTION OF THE DRAWINGS

The accompanying drawings illustrate a preferred embodiment of the present invention, in which.

DESCRIPTION OF THE PREFERRED EMBODIMENT

Figure 1:
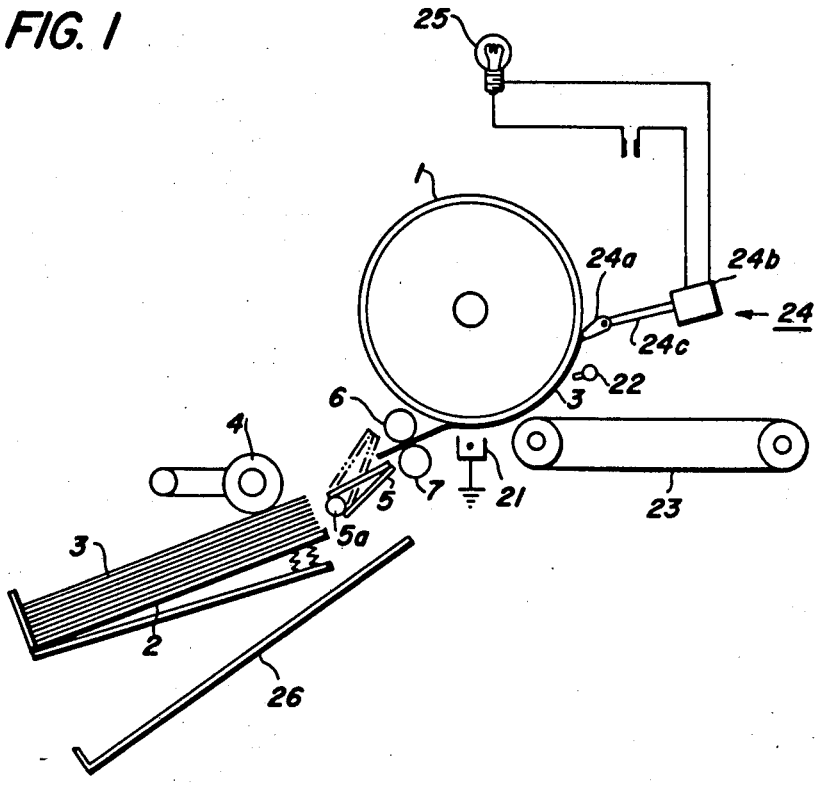
FIG. 1 is a side view.
Figure 2:
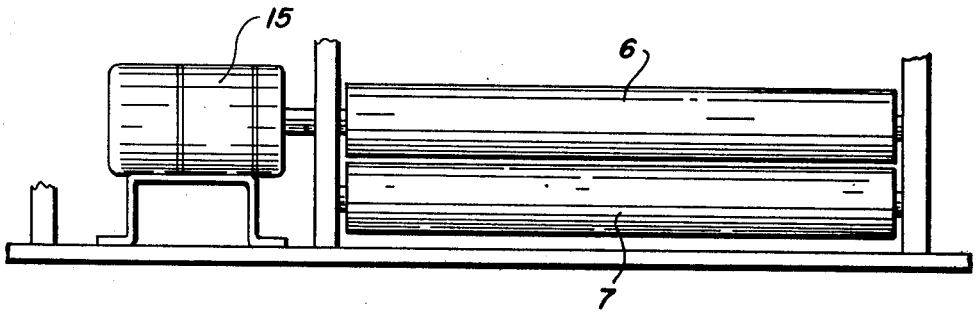
FIG. 2 is a front view of the driving portion of rollers for feeding transfer-sheets.

Referring to the accompanying drawings, there is shown at 1 a photosensitive body of an electrophotographic copying machine (not shown). Provided below said photosensitive body is a sheet tray 2 which houses therein sheets 3 in a stacked manner, each sheet being cut into a predetermined size. Designated at 4 is a feed roller for feeding the sheets 3 to the photosensitive body 1, one by one. A guide plate 5 is provided between the sheet supply tray 2 and the photosensitive body 1, the guide plate being adapted to rest in the position as indicated by the solid line in FIG. 1 while the sheet is being fed and being adapted to move its tip end around a shaft **5*a* to reach to the position as indicated by the dotted line in FIG. 1 so as to feed the sheet in a reverse direction. A pair of rollers 6 and 7 for feeding transfer-sheets are provided between the guide plate 5 and the photosensitive body 1**, the rollers being adapted to rotate in a contacting relationship with each other to feed transfer sheets.

Roller 6 is adapted to be driven in both a forwarding or reversing direction by suitable means, such as reversible motor 15.

Defined at 21 is a corotron which is provided below the photosensitive body 1. A nozzle 22 adapted to inject air toward the photosensitive body 1 is provided for stripping a sheet off said photosensitive body. The sheet 3 stripped by the nozzle 22 is transferred to a fixing station (not shown) by a transfer-sheet feeding device 23. Provided above the nozzle 22 in a close contacting relationship with the photosensitive body 1 is a follower **24*a* which forms part of a detector 24 which detects a failure in stripping a sheet off the photosensitive body. The follower 24*a* is connected to a switch lever 24*c* of the switch 24*b*. When the sheet 3 which fails to strip off the photosensitive body 1 contacts with follower 24*a*, the switch 24*b* is operated. The switch 24*b* is connected to a warning lamp 25 which indicates a stripping failure, and to the driving portion of the guide plate 5 and to the motor 15, so as to light the warning lamp 25 and rotate the guide plate 5 and the transfer-sheet feeding rollers 6 and 7 in a reverse direction. Shown at 26 is a tray for housing the sheets 3** which failed to be stripped off the photosensitive body.

Thus, the sheet 3 fed by the feed roller 4 is subjected to image-transfer on the photosensitive body 1 and is subsequently stripped off the photosensitive body 1 by the air injected from the nozzle 22, so as to be transferred to a fixing station (not shown) by the transfer-sheet feeding device 23. If the sheet 3 fails to be stripped, the follower **24*a* contacts the end of the sheet 3. This operates the switch 24*b* for lighting the warning lamp 25, moving the guide plate 5 to the position as indicated by the dotted line in FIG. 1 as well as for rotating the transfer-sheet feeding rollers 6 and 7 in a reverse direction. At this time, the end of the sheet 3 is still in position between the transfer-sheet feeding rollers 6 and 7 and therefore the sheet 3 is fed in a reverse direction by the reversing transfer-sheet feeding rollers 6 and 7, stripped off the photosensitive body 1 and fed along the guide plate 5 into the tray 26**.

Figure 3:
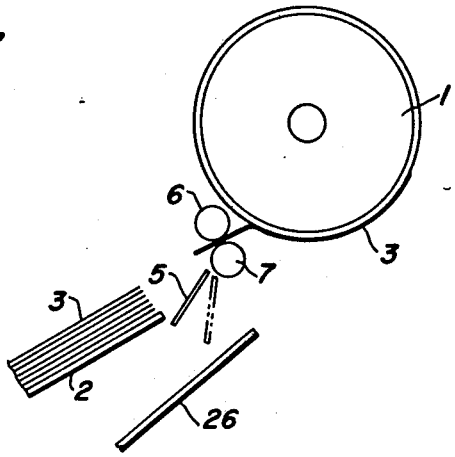
FIG. 3 is an explanatory view of another embodiment of a guide plate.

The aforesaid guide plate 5 may alternatively be moved in a vertical direction as shown in FIG. 3.

Furthermore, in the embodiment shown, the switch **24*b* of the detector 24 is provided for reversing the rollers 6 and 7. However, the operator of copying machine may push the botton for reversing said rollers upon the lighting of the warning lamp 25, so that the reversal of the rollers 6 and 7 and the guide plate 5** can be manually accomplished.

As is apparent from the foregoing description, upon the signal of the detector which is provided for detecting the failure in sheet-stripping, rollers for feeding transfer-sheets are rotated in a reverse direction so that a sheet is stripped off a photosensitive body and the need for removing a sheet from a photosensitive body by hand is eliminated, thereby removing a sheet from a photosensitive body easily in a short time. A further advantage is that even small-sized sheets can be removed with no need to remove a photosensitive body from a copying machine. Therefore, the chance of photosensitive body damage is minimized.

While the invention has been described with reference to the structure disclosed, it is not confined to the details set forth, but is intended to cover such modifications or changes as may come within the scope of the following claims.

What is claimed is:

1. In an electrophotographic copying machine wherein a developed latent image is produced on a photosensitive body and transferred to a copy sheet which is thereafter stripped from the photosensitive body for further processing, a sheet removing device comprising:

a reversible feed roll pair adapted to feed sheets to the photosensitive body for transferring a developed latent image thereto;

detector means for detecting a failure in stripping a sheet off the photosensitive body, and control means actuated by said detector means to reverse said feed roll pair to pull the mis-stripped sheet backward off the photosensitive body.

2. A sheet removing device according to claim 1 wherein said detector means comprises, a follower located adjacent the photosensitive body downstream from the normal stripping point, said follower being adapted for contact by the lead edge of a mis-stripped sheet;

said control means including a switch having a switch lever associated therewith, said follower being mounted on said lever, contact of said follower by a mis-stripped sheet causing said switch lever to move to a position whereat said switch energizes said feed rollers in reverse to pull the mis-stripped sheet off the photosensitive body.

3. A sheet removing device according to claim 2 further including sheet guide means moveable between a first and a second position said guide means being located adjacent said feed roll pair to guide sheets into said roll pair when said rolls are operated in a forward direction and said guide means is in said first position, said control means being adapted to move said guide means to said second position when said roll pair is operated in reverse to deflect the mis-stripped sheet; and, a sheet tray adjacent said guide means to receive mis-stripped sheets deflected thereto by said guide means.

* * * * *